United States Patent [19]

Fujiyoshi et al.

[11] Patent Number: 4,757,168

[45] Date of Patent: Jul. 12, 1988

[54] DECORATIVE IMPROVED SWITCHING APPARATUS HAVING A ROCKING ELEMENT

[75] Inventors: Shiori Fujiyoshi, Kanagawa; Shigeru Matsui, Tokyo, both of Japan

[73] Assignee: Jimbo Electric Co., Ltd., Tokyo, Japan

[21] Appl. No.: 871,328

[22] Filed: Jun. 6, 1986

[30] Foreign Application Priority Data

Jul. 6, 1985 [JP] Japan ..... 60-148694
Jul. 6, 1985 [JP] Japan ..... 60-148695

[51] Int. Cl.[4] ..... H01H 9/00

[52] U.S. Cl. ..... 200/296; 200/330; 174/66

[58] Field of Search ..... 200/296, 330; 174/66

[56] References Cited

U.S. PATENT DOCUMENTS 3,036,185 5/1962 Wiley et al. ..... 200/330
3,364,330 1/1968 Bassani ..... 200/296
3,562,468 2/1971 Stefani ..... 200/296
3,663,781 5/1972 Zimmerman et al. ..... 200/330
3,816,686 6/1974 Budd et al. ..... 200/330

*Primary Examiner*—Renee S. Luebke
*Attorney, Agent, or Firm*—Wegner & Bretschneider

[57] ABSTRACT

A switch device is disclosed, which comprises a mounting frame provided with a switch body or bodies, a reinforcing frame to be provided with a plate, placed on the surface of a building-forming material and threadedly fixed to the mounting frame, a decorative frame fixed integrally with or separately from the reinforcing frame, and a decorative surface sheet or sheets to be fitted into the decorative frame and attached to a switch-working portion or portions of the switch body or bodies and having an area larger than that of the switch body or bodies. A light display for indicating the on.off state of the switch is or are formed on the decorative surface sheet or sheets.

10 Claims, 5 Drawing Sheets

DECORATIVE IMPROVED SWITCHING APPARATUS HAVING A ROCKING ELEMENT

BACKGROUND OF THE INVENTION

1. Field of the Invention

The present invention relates to a switch device and, more specifically to, a switch device designed to be attachable to or detachable from a switch-working portion (to put on or take off the switch) mounted on a decorative rocker element that is larger in size than said portion.

2. Description of the Prior Art

In order to mount such a type of switch, as illustrated in FIG. 5, a mounting frame 1 including switch-working portions 1*a* and 1*a* having projecting bosses is first temporarily fixed to a switch box embedded in an application wall surface by screws 1*c* and 1*c* passing through elongated holes 1*b* and 1*b*, and wallpaper etc. is then applied over the wall surface. Thereafter, the wallpaper covering the mounting frame is partly cut off to expose the frame to open view for the completion of interior finishing. Subsequently, the screws 1*c* and 1*c* are loosened to interpose a lower frame 2 formed of synthetic resin between the wall surface and the mounting frame 1. Projections 2*a* and 2*a* of the lower frame 2 are then engaged and locked within engaging holes 1*d* and 1*d* in the frame 1. The screws 1*c* and 1*c*, are finally tightened. Furthermore, a decorative frame 4 is fitted into a plate 3 to form a one-piece decorative member which is in turn screwed at 4*a*—into internally threaded holes 1*e*-,—in the mounting frame 1. Finally, decorative surface sheets 5 and 5 are attached to the switch-working portions 1*a* and 1*a*.

In the prior art wiring equipment, the mounting frame 1 is integrally provided with upright pieces 1*f* and 1*f*, which include arched portions at their centers, and are designed to abut constantly against the decorative surface sheets 5 in association with the pivoting movement thereof.

The switch-working portions 1*a* and 1*a* also include light-emitting display means 1*g* and 1*g* for indicating the on.off states, which are located near one side edge of each of the adjacent decorative surface sheets 5 and 5.

In the switch device as stated above, one reason why the lower frame 2 should be interposed between the mounting frame 1 and the wall surface is to prevent deformation of the mounting frame 1 toward the switch box due to clamping of the screws 1*c* and 1*c*, when it is attached to the switch box, said deformation making it impossible to pivot the decorative surface sheets 5 and 5. Another reason is that, when wallpaper having a larger thickness is applied over the wall surface, the plate 3 should be mounted at an elevation corresponding to such a thickness, so that the pivoting movement of the decorative surface sheets 5 and 5 does not tend to be impeded.

In other words, to achieve assured and improved pivoting movement of the decorative surface sheets 5 and 5, it is required to keep constant the dimensions between the decorative surface sheets 5 and 5, the decorative frame 4 for receiving the decorative surface sheets 5 and 5 and the switch-working portions 1*a* and 1*a* of the mounting frame 1.

For the conventional switch device as mentioned in the foregoing, it is essentially inevitable to interpose the lower frame 2 between the wall surface and the mounting frame 1. In this case, unless the screws 1*c* and 1*c* which temporarily hold the mounting frame 1 in place are loosened to a considerable extent, then it is impossible to mount the lower frame 2 in place. Mounting of the lower frame 2 is achieved by deeply inserting one projection 2*a* and then the other projection 2*a* in the longitudinal direction of the mounting frame 1.

For the reasons as mentioned in the foregoing, the conventional switch device is of very poor workability, takes an extended period of work time, and is only mounted in place with complicated steps. At the same time, while that switch device provides a solution to the aforesaid first problem by interposing the lower frame 2 between the mounting frame 1 and the wall surface, it does not fully meet the second problem. In addition, whether mounting of the switch device is satisfactory or not is found only upon the completion of attachment of wiring equipment. When the switch device is mounted in an unsatisfactory state, the heads of the screws 1*c* and 1*c* for the mounting frame 1 are hidden behind the back side of the decorative frame 4 integral with the plate 3, even after the decorative surface sheets 5 and 5 have been removed. It is thus impossible to adjust the degree of clamping of the screws 1*c* and 1*c* in a state where the decorative surface sheets 5 and 5 have been removed. This requires that the respective parts be removed in the order opposite to that referred to above, or the screws 1*c* and 1*c* for the mounting frame 1 be loosened for re-application. Where the deformation of the mounting frame 1 is considerable, it should be corrected.

The conventional switch device includes the light-emitting display means 1*g* and 1*g* for indicating the on.off state, which are located toward the edges of the adjacent decorative surface sheets 5 and 5. Thus, light display portions 5*a* and 5*a* of the sheets 5 and 5 are also located toward such edges, so that the appearance of the switch device becomes unnatural and unattractive.

In the conventional switch device as mentioned above, the upright pieces 1*f* and 1*f* for supporting the pivoting movement of the decorative surface sheets 5 and 5 are obtained by cumbersome steps of stamping from the mounting frame 1, followed by bending. The thickness of the upright pieces 1*f* is also determined depending upon the thickness of the mounting frame 1. When it is intended to increase the thickness of the upright piece 1*f* so as to enlarge its surface to abut against the decorative surface sheet 5, the thickness of the mounting frame 1 should be increased, correspondingly. This requires much labor, and offers an economic problem.

In addition, since the upright pieces 1*f* and 1*f* are located very close to the switch-working portions 1*a* and 1*a*, to which the decorative surface sheets 5 and 5 are attached, difficulty is involved in the stable pivoting movement of the decorative surface sheets 5 and 5, larger in size than the switch-working portions 1*a* and 1*a*, depending upon the position on which a pushing force is applied. This arrangement is also very short of durability.

SUMMARY OF THE INVENTION

It is, therefore, an object of the present invention to provide a novel switch device which is of much higher grade design as compared with the conventional one, assures stable pivoting movement of decorative rocker elements, reduces the number of steps of installation, and can easily and satisfactorily be applied for a short period of time.

It is another object of the present invention to provide a novel switch device of the type that is of improved durability.

According to one aspect of the present invention, there is provided a switch device comprising a frame for mounting a switch body, said frame being placed in an embedded box or a hollow wall etc., a reinforcing frame to be provided with a plate, placed on the surface of a building-forming material and threadedly fixed to said mounting frame, a decorative frame fixed integrally with or separately from said reinforcing frame, and a supporting portion designed to have an area larger than that of said switch body, when attached to said switch body.

According to another aspect of the present invention, there is provided a switch device comprising a mounting frame provided with one switch body or two, a reinforcing frame to be provided with a plate, placed on the surface of a building-forming material and threadedly fixed to said mounting frame, a decorative frame fixed integrally with or separately from said reinforcing frame, and decorative rocker elements to be fitted into said decorative frame and attached to a switch-working portion of said switch body and having an area larger than that of said switch body.

Many other advantages, features and additional objects of this invention will become manifest to those versed in the art upon making reference to the detailed description and the accompanying sheet of the drawings on which preferred structural embodiments incorporating the principles of this invention are shown by way of illustrative examples.

EXPLANATION OF THE PREFERRED EMBODIMENTS

Figure 3A:
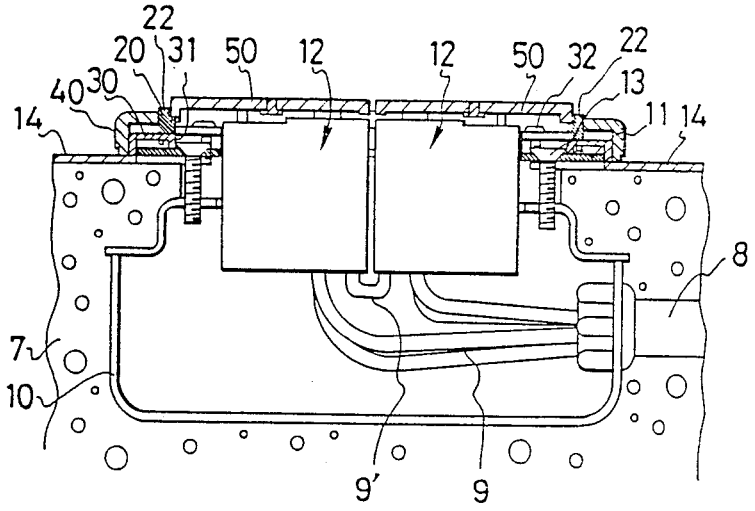
FIGS. 3(A) and 3(B) are longitudinal and traverse sectional views showing the switch device of the present invention, after being attached in place.
Figure 3B:
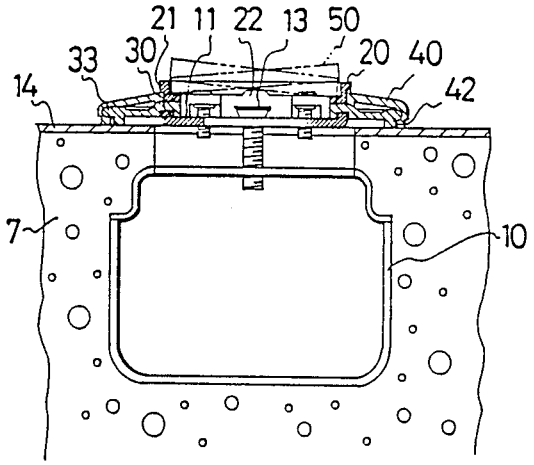

Referring now to FIGS. 3(A) and 3(B), a wall 7 has embedded therein conduit 8 having conducting wires 9 therethrough. The wires 9 pass through a switch box 10 embedded in the wall 7, and are connected to switch bodies 12 and 12 attached to a mounting frame 11.

Figure 4A:
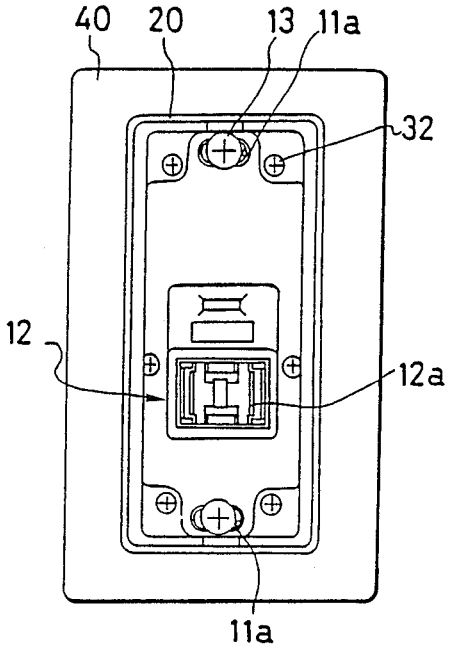
FIGS. 4(A) and 4(B) are plan views showing another embodiment of FIGS. 1(C) and 1(D)
Figure 4B:
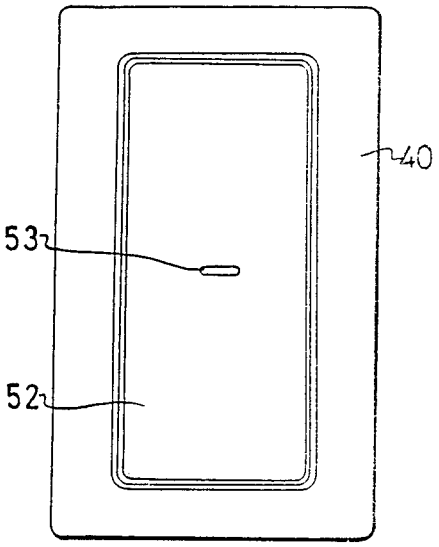
Figure 5:
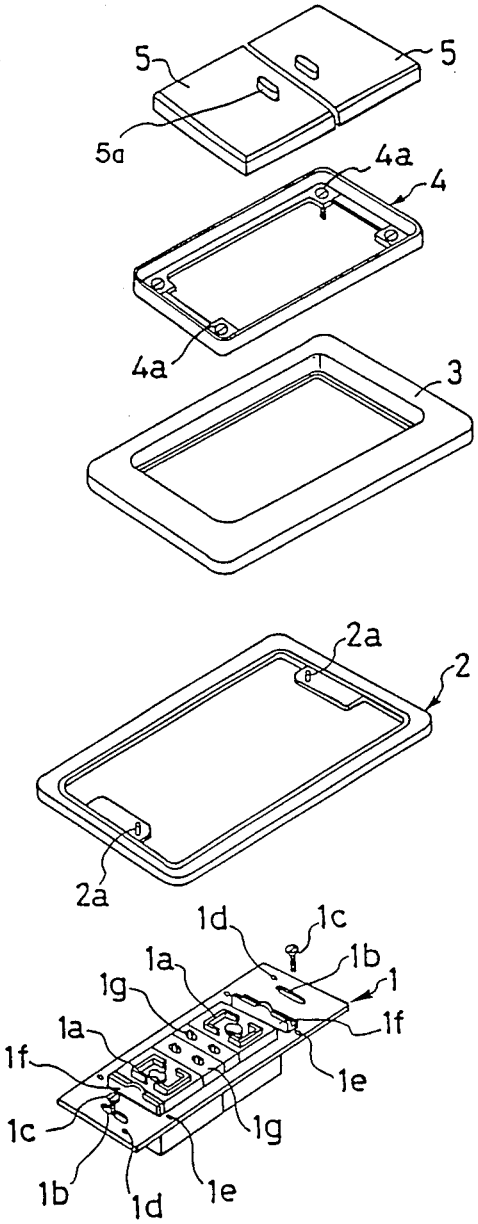
FIG. 5 (PRIOR ART)
FIG. 5 is an exploded perspective view showing one example of the prior art switch device.

The switch bodies 12 and 12 include switch-working portions 12*a* and 12*a*, over which decorative rocker elements 50 and 50 are applied. While the switch bodies 12 and 12 shown in FIGS. 1 to 3 include therein two decorative rocker elements 50 and 50 for two switch bodies, a single switch body may be provided, as illustrated in FIGS. 4(A) and 4(B), with a single decorative rocker element 52. It is a matter of course that each decorative rocker element 50 is of a size half of that of the single decorative element 52. These single element 52 and double elements 50, 50 each have an area larger in size than that of the switch body 12. Also, each of the decorative rocker element or elements can be pivoted over a small angle, so that it works satisfactorily, and its appearance becomes attractive.

Light display means 53 for indicating the on.off state of the switch bodies 12 is or are arranged on the single or double decorative rocker element 52 or elements 50. Combined with the aforesaid attractive appearance, this arrangement thus has a simple and well-balanced appearance.

Figure 1A:
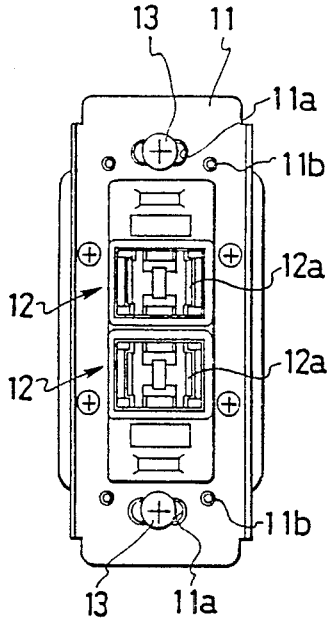
FIGS. 1(A)–(D) are plan views of one embodiment of applying the switch device on an application wall according to the present invention.
Figure 1B:
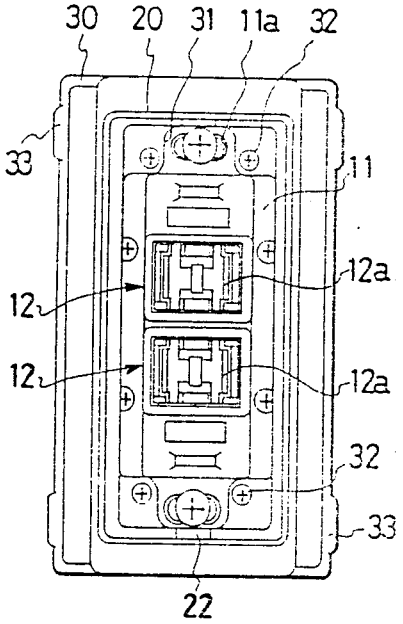
Figure 1C:
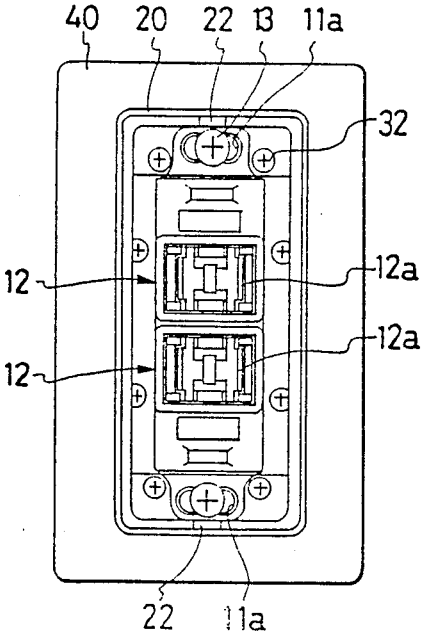
Figure 1D:
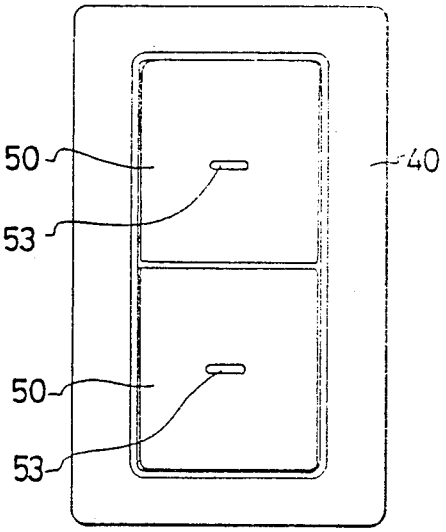
Figure 2A:
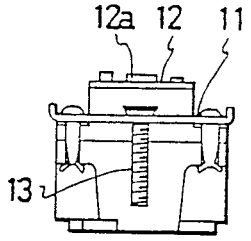
FIGS. 2(A)–(D) are side views of the embodiment of 1(A)–(D) respectively.
Figure 2B:
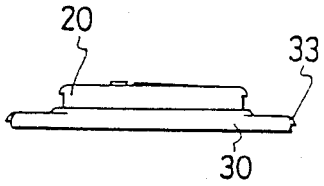
Figure 2C:
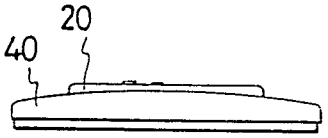
Figure 2D:
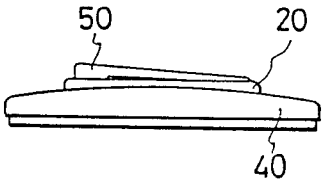

As illustrated in FIG. 1(A), each switch body 12 has a switch working portion 12*a* located at each side thereof and includes therein a switch opening.closing mechanism. Terminal portions are also located on adjacent sides thereof, thus, in the case of a single pole, etc., a crossover wire 9' can be decreased in length, so that work for connecting together the conducting wires 9 can compactly be effected with improved workability.

A mounting frame 11 is fixed to a switch box 10 by screws 13, which are designed to be in threaded engagement with the switch box 10 through elongated holes 11*a*. Reference numeral 14 is wallpaper which may be applied over an application wall 7, and is cut off at a portion correponding to the mounting frame 11 to expose it to open view.

A decorative frame 20 is formed of a die casting material, and is treated on the surface as by plating. In the instant embodiment, the decorative frame 20 is provided separately from a reinforcing frame 30, so that its surface area to be treated is decreased, thus leading to a reduction in the production cost and ease with which a design change can be accommodated. On the other hand, if the decorative frame 20 is made integral with the reinforcing frame 30, it is then possible to omit assembling thereof. It is to be noted that the reinforcing frame 30 may be provided at the end with a projection 33 [see FIGS. 1(B) and 2(B)]. The reinforcing frame 30 is provided on the peripheral edge with a plate 40. This is achieved by fitting the projection 33 of the reinforcing frame in an associated recess 42 formed in the plate 40. In the instant embodiment, the reinforcing frame 30 is formed separately from the decorative frame 20, and the plate 40 is held against the reinforcing frame 30 by a step or stepped portion 21 of the,decorative frame 20. With this arrangement, it is possible to prevent disengagement of the plate 40 from the reinforcing frame 30, even though the surface of a building-forming part such as wallpaper 14 is irregular, or that wallpaper 14 is thicker.

The reinforcing frame 30 has its opening 31 designed in such a manner that, when attached to the mounting frame 11, the screws 13 are exposed at the heads to open view. Accordingly, since the mounting frame 11 is applied over the surface of a building-forming material regardless of the thickness of wallpaper, etc., through the reinforcing frame 30, installation can be carried out in a state where the relative positions of the plate 40, reinforcing frame 30 and decorative frame 20 are stable. Also, installation can be performed under certain conditions that working parts such as wires for the switch are well-fitted under the decorative rocker element and the reinforcing frame 30.

Adjacent to the decorative frame 20, a support piece 22 is provided to support the decorative rocker element 50, when it is applied to the working portion 12*a* of the switch body 12. The support piece is constantly engaged with the decorative rocker element 50 in association with the pivoting movement thereof. Since the support piece 22 is spaced away from the working portion 12*a*, the decorative rocker element 50 is so stably supported in place that its pivoting movement is assured.

The support piece 22 can be made integral with the decorative frame 20 by means of die casting, so that it can be formed into the desired thickness, size, etc., with ease so as to stabilize pivoting movement of the decorative rocker element 50.

In what follows, reference will be made to one order of installation of the switch device according to the present invention.

(1) As illustrated in FIGS. 3(A) and (B), the conduit 8 is embedded in the wall 7, and is connected with the conducting wires 9, which pass through the switch box 10 and are connected to a switch on the mounting frame 11. The mounting frame 11 is then temporarily attached to the switch box 10 by means of the screws 13 [see FIG. 1(A)]. It is noted that the screws 13 are in threaded engagement with the switch box 10 through the elongated holes 11*a* in the mounting frame 11.

(2) Then, the wallpaper 14 is applied over the surface of wall 7, and is cut off in a portion corresponding to the mounting frame 11 to expose it to view. This finishing treatment may be achieved by various means other than the application of wallpaper; however, any reference to the procedures of installation therefor is omitted, since they are almost identical with those for the application of wallpaper. It is thus to be understood that the present invention is not limited to the application of wallpaper.

(3) The screws 13 for the mounting frame 11 are loosened.

(4) The decorative frame 20 made by die casting and previously surface-treated as by plating is provided separately from the reinforcing frame 30. The reinforcing frame 30 is provided therein with the opening 31 in such a manner that the heads of the screws 13 are exposed to view, when attached to the mounting frame 11, and is then clamped and locked in the holes 11*b*, . . . in the mounting frame 11 with the clamp screws 32. It is to be noted that the plate 40 is formed of synthetic resin; however, if that plate is made integral with the reinforcing frame 30, then it may be omitted.

(5) In the state where the mounting frame 11 is temporarily fixed in place by means of the screws 13, it is finally clamped and locked onto the switch box 10.

(6) Finally, the decorative rocker element 50 is mounted on the working portion 12*a* of the switch attached to the mounting frame 11 for pivoting movement.

As mentioned in the foregoing, a separate or integral arrangement of the decorative and reinforcing frames 20 and 30 is fixed by the holes 11*b* in the mounting frame 11, so that there is a considerable increase in the bending strength of the mounting frame 11. It is thus possible to prevent deformation of the mounting frame 11, when it is clamped in place with the screws 13.

Even where the switch device is mounted into a hollow wall, any gap between the mounting frame 11 and the wall is closed up by the reinforcing frame 30. It is thus possible to prevent spreading of a fire, if any, to a neighboring room through a hole formed in the wall surface.

Obviously, many modifications and variations of the present invention are possible in the light of above teachings. It is therefore to be understood that within the scope of the appended claims, the invention may be practiced otherwise than as specifically described.

What is claimed is:

1. A switch device for operating a switch having an on and an off state, comprising:

a mounting frame for mounting a switch body, said frame being placed on an embedded box or hollow wall;

means for preventing the mounting frame from being deformed when attached to the embedded box or hollow wall, said preventing means comprising a reinforcing frame placed on a surface of a building-forming material and threadedly fixed to said mounting frame;

a plate attachable to the reinforcing frame;

a decorative frame fixed integrally with or separately from said reinforcing frame;

a support piece plate located inside the decorative frame and adjacent thereto; and a decorative rocker element attached to the switch body and having an area larger than that of the switch body, said decorative rocker element being pivotable about the support piece so as to operate the switch.

2. A switch device as claimed in claim 1, wherein said reinforcing frame and decorative frame are provided separately, and said plate is held to the reinforcing frame by said decorative frame.

3. A switch device as claimed in claim 1 or 2, further comprising a screw to attach the mounting frame to the embedded box or hollow wall, said screw having a head, wherein said reinforcing frame has an opening therein which exposes the head of the screw to view.

4. A switch device as claimed in claim 1, wherein the decorative rocker element is provided with a light display means for indicating the on/off state of the switch.

5. A switch device for operating at least one switch having an on and an off state, comprising:

a mounting frame provided with a switch body;

means for preventing the mounting frame from being deformed when attached to an embedded box or a hollow wall, said preventing means comprising a reinforcing frame placed on a surface of a building-forming material and threadedly fixed to said mounting frame;

a plate attachable to the reinforcing frame;

a decorative frame fixed integrally with or separately from said reinforcing frame;

a decorative rocker element fitted into the decorative frame and attached to a switch-working portion of the switch body, said decorative rocker element having an area larger than that of the switch body,

6. A switch device as claimed in claim 5, wherein said decorative surface sheet includes at its center a light display means for indicating the on/off state of the switch.

7. A switch device as claimed in claim 5, wherein said switch device is capable of operating two switches, said mounting frame is provided with two switch bodies, and said device comprises two decorative rocker elements.

8. A switch device as claimed in claim 7, wherein said decorative rocker elements includes at their centers light display means for indicating the on/off state of the switches.

9. A switch device as claimed in claim 7 or 8, wherein said switch bodies have switch working portions on adjacent surfaces thereof, each switch working portion having an operating mechanism for operating one of the switches.

10. A switch device as claimed in claim 5, 6, 7 or 8, further comprising a screw to attach said mounting frame to an embedded box or hollow wall, said screw having a head, wherein said reinforcing frame has an opening therein which exposes the head of the screw to view.

* * * * *